United States Patent [19]

Wiczer

[11] Patent Number: 4,648,599

[45] Date of Patent: Mar. 10, 1987

[54] PINBALL MACHINE WITH MODULAR DISPLAY

[75] Inventor: Max Wiczer, Skokie, Ill.

[73] Assignee: Wico Distribution Company, L. P., Niles, Ill.

[21] Appl. No.: 722,463

[22] Filed: Apr. 12, 1985

[51] Int. Cl.[4] ..... A63F 7/00

[52] U.S. Cl. ..... 273/121 A; 340/815.14; 273/1 ES

[58] Field of Search ..... 273/118 A–122 A, 273/1 ES; 340/323 R, 815.14, 815.2; 362/362–368; 40/446–452; 339/17 M

[56] References Cited

U.S. PATENT DOCUMENTS

| | | | |
|---|---|---|---|
| 3,719,941 | 3/1973 | Dickey et al. | 340/815.14 |
| 4,017,077 | 4/1977 | Burnside | 273/121 A |
| 4,133,592 | 1/1979 | Cobaugh et al. | 339/17 M |

*Primary Examiner*—Richard C. Pinkham
*Assistant Examiner*—MaryAnn Stoll Lastova
*Attorney, Agent, or Firm*—Emrich & Dithmar

[57] ABSTRACT

A modular display assembly for mounting as a unit in the display cabinet of a pinball machine, includes digital display units mounted on three printed circuit display boards which are secured to a frame by a pair of interconnect printed circuit boards each of which electrically interconnects printed wiring conductors on a pair of adjacent display boards and each of which carries indicator lamps. An opaque display panel mounted on the front of the frame encloses the display boards, the display panel having clear areas in registration with the display units and bearing game status indicia which is backlighted by the indicator lamps for indicating game status.

13 Claims, 5 Drawing Figures

FIG. 1
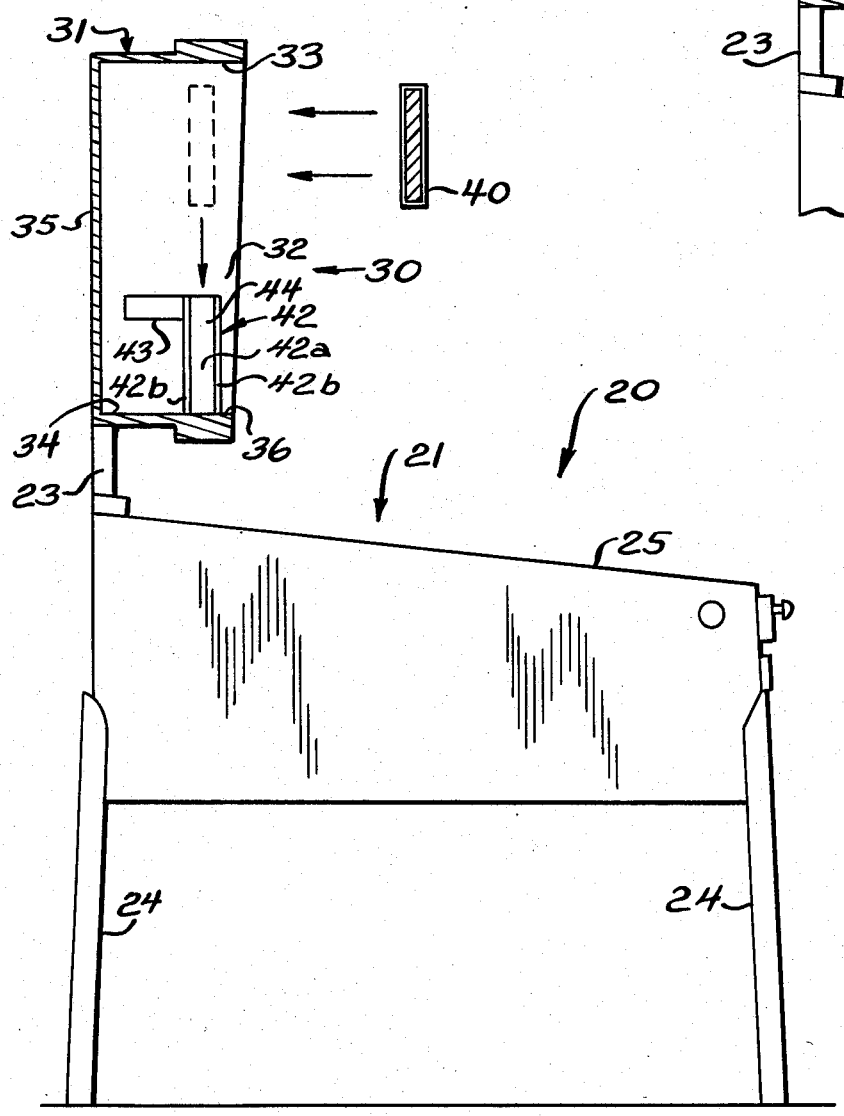
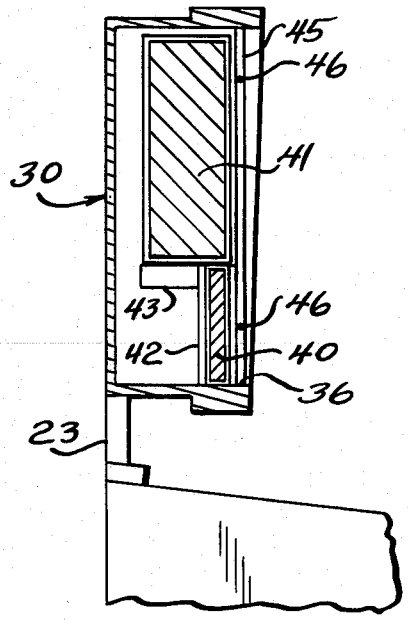
FIG. 2

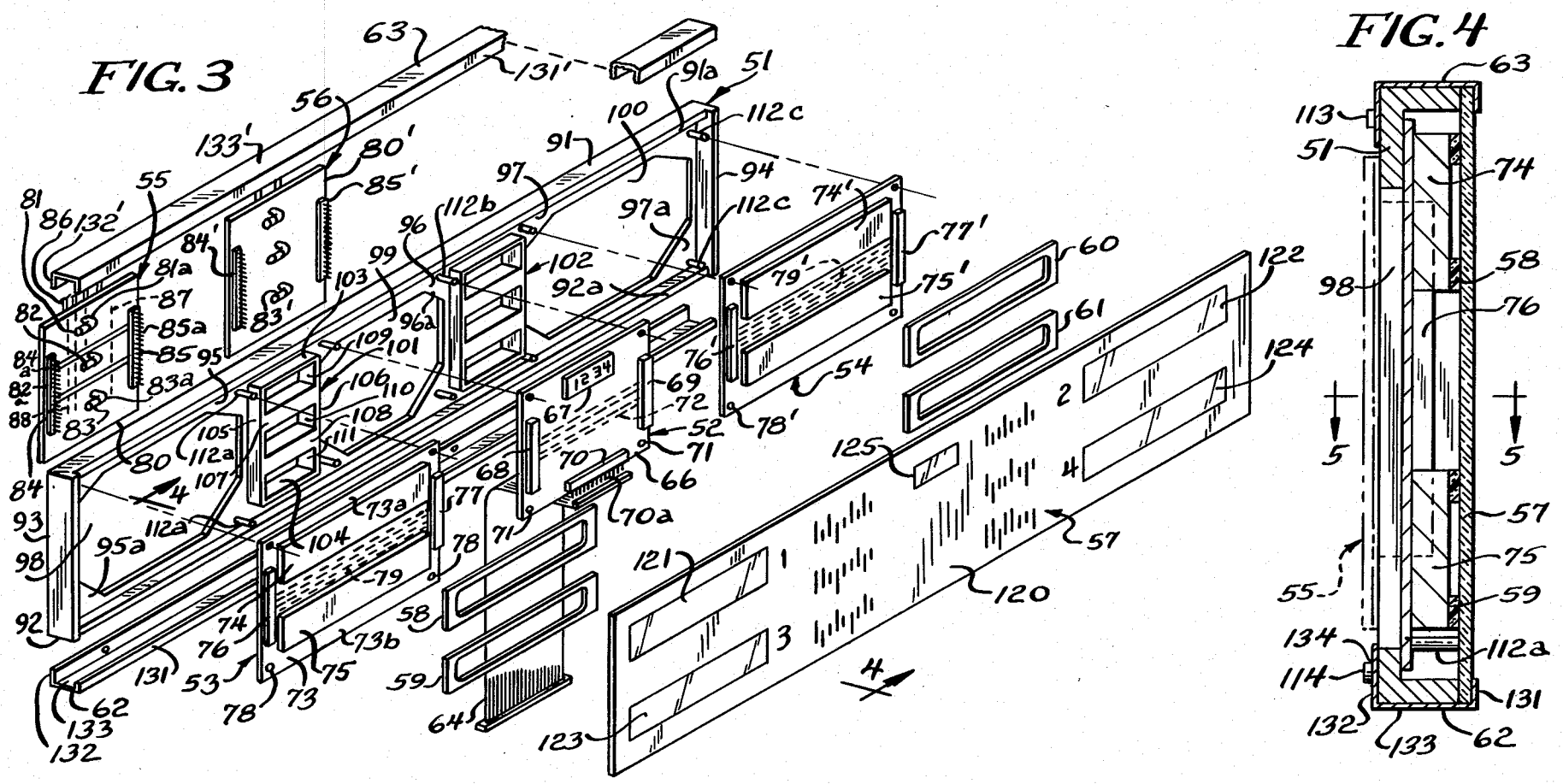
FIG. 4
FIG. 3
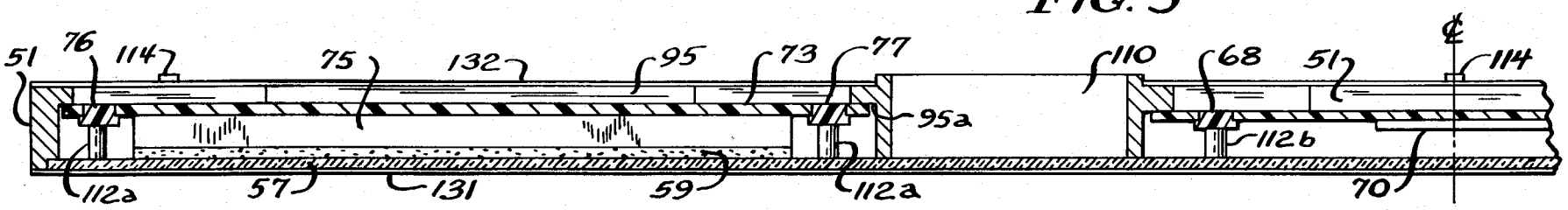
FIG. 5

PINBALL MACHINE WITH MODULAR DISPLAY

BACKGROUND OF THE INVENTION

This invention relates to pinball machines of the type which include a lower cabinet containing the playfield board and an upper cabinet containing various scoring displays and other displays, and in particular to a modular display assembly for such pinball machines.

In many pinball machines a lower playfield cabinet has mounted thereon an upstanding display cabinet which projects vertically upwardly from the lower cabinet. The display cabinet houses a plurality of photooptical and/or mechanical indicating devices which display player scores and game status information.

In a typical pinball machine, separate score display devices are provided for four or more players. The score display devices may be a drum score unit or a digital display unit with associated display driver printed circuit board. Additional display devices are provided for indicating game status information such as which player is up, bonus plays, end of game, etc. The game status information is generally displayed using low intensity lamps which selectively back light areas on the glass display panel which is mounted on the front of the display cabinet. The display panel which encloses the forward end of the display cabinet, is silkscreened with decorative imagery related to the game to hide from view the display circuitry but has clear areas for exposing to view the player score display devices which are mounted behind the display panel. The game status information to be illuminated is also silkscreened onto the display panel.

Conventionally, score display devices are located in upper left and right hand corners of the display cabinet and as such are located at a height two to three feet above the playing field. This requires that the player tilt his head up and down, continually to view the score panel as well as the playing field while playing the game, and this could result in loss of concentration.

In assembly of pinball machines of this type, the several discrete indicating devices are usually attached to the inner side or back walls of the display cabinet, with each display device being mounted individually. Electrical connections must be made between each display device and the control circuits for the pinball machine which are typically located in the lower cabinet. The mounting of the many discrete display devices within the display cabinet and making required electrical connections between the display devices and the control circuitry requires considerable time and is thus expensive. Moreover, service and repair either must be done on-site, or the entire pinball machine must be shipped to the factory or service representative. Either situation could result in temporary loss of the machine and the revenues which would otherwise be obtained if down time for the machine were minimized.

BRIEF SUMMARY OF THE INVENTION

It is a general object of the invention to provide an improved pinball machine with a display assembly which avoids the disadvantages of prior such pinball machines while affording additional structural and operating advantages.

An important object of the invention is the provision of a pinball machine with a modular display assembly which is adapted to be mounted as a unit in the upper display cabinet of the pinball machine.

Another object of the invention is the provision of a pinball machine which provides improved viewing of the score display relative to the playing field.

These and other objects of the invention are attained by the present invention which has provided a pinball machine including a modular display assembly for providing a display of game information including player score and game status information, the modular display assembly comprising support means, a plurality of display means, interconnect means and a display panel; said support means having a front surface and a rear surface, said front surface having a plurality of recesses and a plurality of apertures through said support means from said front surface to said rear surface; each of said display means including a display unit for displaying game information and being located in a different one of said recesses of said support means, said interconnect means being located rearwardly of said support means adjacent to said aperture and including means in cooperative engagement with said display means through said apertures securing said display means to said support means, said display panel having clear and opaque areas and being located at said front surface of said support means forward of said display means, enclosing said display means within said support means with its clear areas in registration with said display units, exposing them to view.

Further in accordance with the invention there is provided a pinball machine including a modular display assembly for providing a display of game information including player score and game status information, said modular assembly comprising support means; a plurality of display means; interconnect means and a display panel; said support means including a frame having a front surface and a rear surface and at least one aperture through said frame from said front surface to said rear surface, each of said display means including mounting means of an electrically insulating material, a display unit mounted on said mounting means for displaying game information, and a set of control signal distribution conductors disposed on said mounting means with at least certain ones of said conductors being connected to said display unit, one of said display means further including a set of input conductors selectively connected to said control signal distribution conductors, and connector means for connecting said input conductors to the control circuits, said plurality of display means being located at the front surface of said frame adjacent to said apertures, said interconnect means being located at the rear surface of said frame adjacent to said apertures and including means disposed in cooperation relationship with said plurality of display means through said apertures for securing said display means to said frame, said interconnect means including interconnect conductor means interconnecting control signal distribution conductors of said one display means with corresponding control signal distribution conductors of another one of said display means, said display panel being located at the front surface of said frame enclosing said first and second display means therewithin and defining a clear display area for exposing said display units to view.

Further in accordance with the invention, there is provided a pinball machine including a lower playfield cabinet and an upper cabinet, the lower cabinet having a forward end defining a player position and a rearward end, the upper cabinet being supported on the lower cabinet near its rearward end, the upper cabinet having an open forward end facing the player position, and a display assembly for providing a display of game information including player scores and game status information, said display assembly comprising a decorative panel, a display module including a plurality of display means, support means and a display panel and mounting means for mounting said decorative panel and said display module in the upper cabinet; each of said display means including a display unit providing a display of different game information: said support means supporting said display means at a front surface thereof and said display panel having clear and opaque areas and being mounted on said support means at said front surface enclosing said display means, said display panel having its clear areas in registration with said display units exposing them to view; said display module being mounted in the upper panel near its open forward end enclosing the lower portion thereof, and said decorative panel being mounted in the upper panel near its open forward end enclosing the upper portion thereof, the game information provided by all of said display units being displayed in the lower portion of the upper cabinet at a level corresponding to the line of sight of the player.

The invention consists of certain novel features and a combination of parts hereinafter fully described, illustrated in the accompanying drawings, and particularly pointd out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considerd in connection with the following description, the invention, its construction and operation, and many of its advantages should be readily understood and appreciated.

FIG. 1 is a side elevational view of a pinball machine illustrating a modular display assembly constructed in accordance with and embodying the features of the present invention, prior to mounting in the upper cabinet of the machine;

FIG. 2 is a fragmentary view similar to FIG. 1, showing the modular display assembly mounted in the upper cabinet;

FIG. 3 is an exploded view of the modular display assembly of the present invention;

FIG. 4 is an enlarged view in vertical section taken along the line 4—4 in FIG. 3; and FIG. 5 is an enlarged, fragmentary view in horizontal section taken along the line 5—5 in FIG. 4.

DESCRIPTIN OF THE PREFERRED EMBODIMENT

Referring to FIGS. 1 and 2 of the drawings, there is illustrated a pinball machine, generally designated by the numeral 20, including a lower cabinet 21 and an upper cabinet 30 supported above the lower cabinet 21 by a support 23. The lower cabinet 21 is generally in the shape of a rectangular box and is supported upon the floor or other underlying support surface by four legs 24, respectively disposed at the corners of the lower cabinet 21. Typically, a playfield board (not shown) is mounted in the lower cabinet 21 and is recessed a slight distance below the upper edges 25. The playfield board may be covered with a transparent cover of glass, plastic or the like, all in a known manner.

The upper cabinet 30 includes a rectangular frame 31 including two opposed rectangular side walls, such as side wall 32, a top wall 33, a bottom wall 34, and a rear wall 35. The frame 31 is open at the front edges thereof disposed forward at the front edge 36 of the frame 31 is a display module assembly 40 (FIG. 2), provided in accordance with the present invention, which includes a variety of displays, including scoring displays, game status displays, and the like, and which closes the lower portion of the upper cabinet 30, and a reflector marquee assembly 41 which carries decorative indicia.

The upper cabinet 30 further includes a pair of edge guide members such as edge guide member 42, a pair of support members, such as support member 43, and a pair of retainer strips, such as retainer strip 45 shown in FIG. 2, and suitable mounting means such as screws 46.

Referring to FIG. 1, the display module assembly 40, assembled in a manner to be described hereinafter, is a generally flat rectangular unit having a rectangular cross section. Each edge guide member 42 has a rectangular base portion 42*a* with a pair of rails 42*b* extending perpendicular to the base section in a spaced apart relation defining a channel 44 therebetween which is of a width corresponding to the thickness of the display module assembly 40. Edge guide member 42 is secured to the inside of the side wall 32 in a vertical orientation with its open channel portion 44 directed outwardly therefrom near the forward edge of the frame 31. The other edge guide member is mounted on the opposite side wall in a similar manner. The edge guide members 42 mount the display module assembly 40 which has its left and right edges held in the channels 44 of the two edge guide members 42 and its lower edge resting on the upper surface of the bottom wall 34 near the forward edge 36 of the upper cabinet 30. The use of the edge guide members 42 obviates the need for additional hardware for mounting the display module assembly 40 in the upper cabinet of the pinball machine.

Each support member, such as support member 43, is a generally rectangular member which attached to the inner surface of the opposing side walls 32 at a height corresponding to the height of the top edge of the edge guide members 42. Support member 43 extends horizontally defining a support for the rearward portion of the reflector marquee assembly which has its forward portion supported on the top surface of the guide member 42. The reflector marquee assembly 41 is maintained in place by the retainer strips at left and right edges, such as retainer strip 45 which extends along the right edge of the reflector marquee assembly 41 and is secured to the side wall 32 by screws 46.

Considering the display module assembly in more detail, with reference to FIG. 3, the display module assembly 40 includes a frame 51, a player status display board 52, two score display boards 53 and 54, two interconnect boards 55 and 56, a display panel 57, four spacer members 58–61, a lower channel member 62, an upper channel member 63, and a ribbon cable 64.

Display board 52 includes a printed circuit board 66, a four-digit display unit 67, two female printed circuit connectors 68 and 69, and a male printed circuit connector 70 having terminals 70*a*. A set of printed wiring conductors 72 are disposed on the back surface of the printed circuit board 66. Four locator apertures 71 are provided in the four corners of the printed circuit board 66.

The display unit 67 provides a display of the digits one through four, energizable one at a time for indicating player 1, player 2, player 3 or player 4. Control signals for activating the display unit 67 are provided through the ribbon cable 64 which is plugged into the connector 70. Connector 70 is mounted on the forward surface of the printed circuit board 66 near its lower edge with its terminals 70*a* projecting downwardly. Certain ones of the printed wiring conductors 72 on the back of the printed circuit board 66 connect the display unit 67 to terminals of connector 70 which in turn is connected via ribbon cable 64 to the pinball machine control circuitry located in the lower cabinet 21. Further ones of the printed wiring conductors 72 serve as control signal distribution conductors which extend between the left and right edges of the printed circuit board 66 and are connected to terminals of the printed circuit connectors 68 and 69. Connector 68 extends through a vertically extending aperture (not shown) along the left edge of the printed circuit board 66 and connector 69 extends through a vertically extending aperture (not shown) along the right edge of the printed circuit board 66. Both connectors 68 and 69 having terminal receptacles (not shown) exposed at the backside of the printed circuit board 66. The control signal distribution conductors extend control and power signals from the pinball control circuits housed in the lower cabinet 21 to score display units and game status indicators of the display module assembly 40 in a manner to be described.

The score display board 53 includes a printed circuit board 73, two digital display units 74 and 75, two printed circuit board connectors 76 and 77, and printed wiring conductors 79. The printed circuit board 73 has four locator holes 78, one in each corner of the board.

Each score display unit, such as score display unit 74, comprises a seven-digit segmented LED digital display device. Score display unit 74 extends horizontally along the upper portion 73*a* of the printed circuit card 73 on the forward surface thereof and provides a display of the score for player 1. Display unit 74, which provides display for the game score for player number 3, is mounted on the forward surface of the printed circuit board 73 extending horizontally therealong and near the bottom edge 73*b* and beneath score display unit 74. Control signals for energizing the display units 74 and 75 are provided by printed wiring conductors 79 on the back surface of the printed circuit board 73, and which terminate near the right and left edges of the printed circuit board 73. The conductors 79 are connected to terminals of the connectors 76 and 77 which are mounted on and extend through the printed circuit board 73 near its left and right edges, respectively, exposing terminal receptacles (not shown) at the back side of the printed circuit board 73.

The score display board 54 is identical to and interchangeable with score display board 53 and accordingly corresponding elements have been given the same reference number with a prime notation.

Interconnect board 55 includes a printed circuit board 80, three indicator lamps 81, 82 and 83 with associated sockets 81*a*, 82*a* and 83*a*, two male printed circuit connectors 84 and 85, having terminals 84*a* and 85*a*, and an indicator lamp connector 86. A first set of printed wiring conductors 87 are disposed on the front surface of the printed circuit board 80 and a second set of printed wiring conductors 88 is disposed on the back surface of the printed circuit board 80.

The three indicator lamps 81, 82 and 83 are mounted in an aligned spaced relationship at the center of the printed circuit board 80. Power is supplied selectively to the lamps 81–83 by way of printed wiring conductors 88 disposed on the rearward surface of the printed circuit board 80. The conductors 88 which terminate in the indicator lamp connector 86 which is located at the upper edge of the printed circuit board 80. In this embodiment, a separate input connector extends control signal for indicator lamps 81–83 via the indicator lamp connector 86. However, such control signals could also be extended via the set of printed wiring conductors 87 on the front surface of the printed circuit board 80. Printed wiring conductors 87 which extend across the front surface of the printed circuit board 80 interconnect the terminals 84*a* of printed circuit board connector 84, mounted near the left edge of the printed circuit board 80, with terminals 85*a* of printed circuit connector 85 located near the right edge of the printed circuit board 80. Printed circuit connectors 84 and 85 have their terminals extending forwardly of the printed circuit board 80. As will be shown, interconnect board 55 mechanically connects score display board 53 and player status display board 52 to the frame 51, and via circuit connectors 84 and 85, electrically interconnects the sets of printed conductors 79 and 72 on these boards so that the control and power signals from the pinball control circuits are extended, the display devices of score display board 53 as well as to player status display board.

Interconnect board 56 is identical to and interchangeable with interconnect board 55 and accordingly corresponding elements have been given the same reference numeral with a prime notation. Interconnect board 56 mechanically connects player status display board 52 and score display board 54 to the frame 51, and electrically interconnects the sets of printed conductors on these boards, to extend the control and power signals from the pinball control circuits to the display devices of score display board 54 as well as to player status display board 52.

Turning now to the frame 51, the frame 51 is generally rectangular in shape and is of a rigid plastic material. The frame has a top 91, a bottom 92, a left side 93 and a right side 94. The frame has three recessed surfaces 95, 96 and 97 formed in its forward surface. The recessed surfaces 95, 96, 97 are formed with a generally octagonal aperture indicated at numerals 98, 99 and 100, respectively, through the frame 51 whereby the recessed surfaces 95–97 define mounting ledges 95*a*–97*a* around the periphery of the apertures. A raised section 101 is defined between apertures 98 and 99, and an identical section 102 is defined between apertures 99 and 100.

The section 101 includes top wall 103, bottom wall 104, side walls 105 and 106 and dividing walls 107 and 108 which extend horizontally in a spaced relation parallel to top and bottom walls 103, 104 between side walls 105 and 106 defining three rectangular shaped windows 109, 110 and 111 through the frame 51 from its rearward edge to its forward edge for locating respective indicator lamps 81–83 in light isolation relationship. The section 102 is identical to the section 101 and accordingly corresponding elements have been given the same reference numerals with a prime notation.

The frame 51 further includes forwardly projecting locator pegs, including three sets of four pegs 112*a*–112*c*, which are formed integrally with the frame 51 and project forwardly from the recessed surfaces 95, 96 and 97 for aligning the score display board 53, the status display board 52 and the score display board 54 in the modular display assembly. The frame 51 also includes rearwardly projecting nibs, such as nibs 113 and 114 shown in FIG. 4. Three nibs 113 are provided on the frame near its upper rearward edge, one near each end and one at the middle of the frame 51. Similarly, three nibs 114 are provided near the bottom edge of the frame including a nib near each corner and one at the center of the frame.

The length and width of the recessed surface 95 are dimensioned to correspond to the length and width of printed circuit board 73 of score display board 53. The four locator pegs 112*a* are located at the four corners of the generally rectangular space defined by the recessed surface 95 between left side wall 93 and the left side wall 106 of the section 101. The locator pegs 112*a* are received in the locator apertures 78 of printed circuit board 66 in the assembled module to locate the connector 77 in receptacles are aligned with terminals 84*a* of connector position near the right edge of the aperture 98 where its 84 of interconnect board 55. The depth of the recessed surface 95 corresponds to the thickness of the score display board 53, including display units 74 and 75, so that the display units 74 and 75 thereof are substantially flush with the forward edge of the frame 51.

Similarly, the score display board 54 is mounted in rercessed surface 97 with locator pegs 112*c* received in locator apertures 78' and with its connector 76' located near the left edge of the aperture 100 with its receptacles in alignment with terminals 85*a'* of connector 85' on interconnect board 56.

The center recessed surface 96 is dimensioned to correspond to the dimensions of the printed circuit board 66 of the player status display board 52. The four locator pegs 112*b* are located at the four corners of the recessed surface 96 and are received by the locator apertures 71 in the printed circuit board 66 to locate receptacles of its connectors 68 and 69 at the left and right edges, respectively of the aperture 99 in recessed surface 96, to be aligned with terminals 85*a* and 84*a'* of connectors 85 and 84' at the rear of the frame 51.

The windows 109, 110 and 111 in the section 101 locate the three indicator lamps 81, 82 and 83 on the printed circuit board 80 and define light baffles for each of the lamps 81–83. As will be shown, with the interconnect board 55 positioned at the rear surface of the frame 51 with lamps 81–83 located in the rearward portion of the windows 109–111, respectively, the printed circuit board 80 and its connectors 84 and 85, straddles the section 101, locating the forwardly projecting terminals 84*a* and 85*a* of the printed circuit connectors 84 and 85 in the receptacles of connectors 77 and 68 on printed circuit boards 73 and 66. In this way, the set of control signal distribution conductors 72 on the printed circuit board 66 are interconnected with the set of control signal distribution conductors 79 on printed circuit board 73. Similarly, the printed circuit connectors 84' and 85' on printed circuit board 80' interconnect the set of control signal distribution conductors 72 on printed circuit board 66 with the set of control signal distribution conductors 79' on printed circuit board 73'. Accordingly, control signals applied to the display board 52 via ribbon cable 64 from the pinball control circuits in the lower cabinet 21 are extended to the control signal distribution conductors to the player display board 52 and in turn conducted to the control signal distribution conductors of the two score display boards 53 and 54 by way of conductors of the interconnect boards 55 and 56, respectively.

The forward eges of the top 91 and the bottom 92 of the frame 51 are recessed inwardly a distance corresponding to the thickness of display panel 57, defining shoulders 91*a* and 92*a* for enabling flush mounting of the display panel 57 relative to the forward edge of the frame 51.

The display panel 57 is of glass or transparent plastic material. The front surface 120 of the display panel 57 is covered with a pattern of ink, as by silk screening, to cover the printed circuit boards of the display module assembly. The pattern defines four areas or transparent windows 121–124 to expose to view the four score display units and a further window 125 to expose to view the player indicator display unit 67. The pattern formed on the display panel 57 may also define the numerals 1–4 adjacent the score windows 121–124. In addition, further information is provided forward of the six indicator lamps 81–83, 81'–83' on the interconnect boards 55 and 56, indicating game status information such as "shoot again", "high score", "tilt", "ball in play", "match", and "game over". These areas are selectively back lighted by the indicator lamps 81–83 and 81'–83' during the course of a game.

The spacers 58–61, which may be of foam, are in the shape of a generally rectangular frame with its center portion cut out. In the assembled module, spacers 58–61 are located between the player score display boards 53 and 54 and the display panel 57 with the individual spacers 58–61 being located between the forward edge of the score display units 74, 75, 74' and 75', respectively and the back surface of the display panel 57.

Turning now to the channel members 62 and 63 which hold the display module assembly together, channel member 63 has a generally U-shaped cross section with a forward leg 131 and a rearward leg 132 extending generally vertically upward from a base portion 133. The rearward leg 132 extends vertically upward higher than the forward leg 131 and is provided with three apertures, such as 134 shown in FIG. 3, which are adapted to receive the nibs 114. The upper channel member 63 is identical to the lower channel member 62, but used in an inverted position so that its legs 131' and 132' extend downwardly from its base portion 133'.

The spacing between the legs 131–132 corresponds to the thickness of the side walls 93 and 94 of the frame 51 such that when assembled with the display panel 57 located on the shoulders 91*a* and 92*a* at the forward surface of the frame 51, the channel members 62 and 63 will have their forward legs 131 and 131' extending along the front surface 120 of the display panel 57 and their rear leg portions 132 and 132' extending along the back surface of the frame.

Referring to FIGS. 3–5, in assembling the display module assembly 40, display board 53 is positioned in recessed surface 95 with the four pegs 112*a* received in the four apertures 78 in the outer corners of the printed circuit board 73. Similarly, the status display board 52 is located in recessed surface 96 with the four pegs 112*b* received in the apertures 71 in the printed circuit board 66. The score display board 54 is located in recessed surface 97 with the four locator pins 112*c* extending through apertures 78′ in the printed circuit board 73′.

The interconnect board 55 is then set in place with indicator lamps 81–83 positioned in the windows 109–111, respectively in the section 101 of the frame 51 with terminals 84*a*, 85*a* of connectors 84 and 85 in alignment with the receptacles of the connectors 77 and 68 on respective printed circuit boards of the score display board 53 and the player status display board 52 as described above. When the interconnect board 55 is moved inwardly toward the display boards 52 and 53, the terminals 84*a* and 85*a* engage the female connector receptacles, locking the display boards 52 and 53 to the interconnect board 55 with the frame 51 sandwiched therebetween and the control signal distribution conductors interconnected as described above.

Similarly, interconnect board 56 is connected to lock player status display board 52 and score display board 54 to the frame and to interconnect the control signal distribution conductors on the player status display board 52 with those on the score display board 54 via connectors 84′ and 85′ on the interconnect board 56 and female connectors 69 and 76′ on player status display board 52 and score display board 54.

The ribbon cable 64 is then attached to the connector 70 on the bottom edge of the player status display board 52, the ribbon cable passing through the center aperture 99 in the frame 51 to the rear surface of the frame 51.

With the display module thus far assembled, it is positioned lying on its backside, enabling the four spacers 58–61 to be positioned on the front surface of the four-digital score display units 74, 75, 74′ and 75′. The display panel 57 is then placed on top of the frame with its outer peripheral edge resting on the two shoulders 91*a* and 92*a*. The assembly is locked together by the channel member 62 and the channel member 63. The channel member 62 is set in place by positioning the channel member at an angle of approximately 45 degrees relative to the edge of the frame 51 and with its shorter front leg 131 engaging the front surface of the display panel 57 near its lower edge. The channel member 62 is then pivoted rearwardly until the nibs 114 snap into the apertures 134 in the rear leg 132. The other channel member 63 is installed in a similar manner at the top edge of the frame.

Referring to FIG. 1, the thus assembled display module assembly 40 is then mounted in the upper cabinet 30 of the pinball machine 20. The display module assembly 40 is positioned forward of the upper portion of the open end of the upper cabinet 30 as shown in FIG. 1 and is then moved horizontally until it is located in a position just within the forward edge of the upper cabinet 30 as illustrated by the dashed line in FIG. 1, where it overlies the edge guide members 42. The display module assembly 40 is then moved vertically downward in the direction of the arrow until its side edges engage the edge guide members 42. The display assembly 40 is then lowered into place with its bottom edge resting on the upper surface of the bottom wall 34 of the upper cabinet 30. The ribbon cable 64 (FIG. 3) is then passed through the hollow support 23 to the lower cabinet 21 for connection to the control circuits.

Referring to FIG. 2, to complete the assembly, once the display module assembly 40 is in place, the reflector marquee assembly 41 is slid horizontally into place above the display assembly 40 with its bottom edge resting on the side support members 43. The retainer strips 45 are then attached to the side walls 32 by screws 46 to retain the reflector marquee assembly 41 in place.

In the pinball machine provided by the present invention, all game information is displayed in the lower portion of the upper cabinet 30 at a level corresponding to the line of sight of the player. Thus, the player can view any information displayed with a slight shift of his eyes from the playingfield to the display panel, without moving his head.

For service or repair, the entire display module assembly can be removed and replaced with a like unit while the faulty unit is being serviced. Such replacement can be done in a matter of minutes, minimizing the time the pinball machine is out of service.

I claim:

1. In a pinball machine including a lower playfield cabinet and an upper cabinet supported on the lower cabinet, a modular display assembly for providing a display of game information including player score and game status information, said modular display assembly comprising support means, a plurality of display means, interconnect means, and a display panel, said support means including a generally rectangular frame having top and bottom walls and a pair of side walls and having a front surface and a rear surface, said front surface having a plurality of recesses and a plurality of apertures through said support means from said front surface to said rear surface, the center portion of each recess being cut away defining certain ones of said apertures and the peripheral edges of each recess defining a mounting shoulder, each of said display means including a display unit for displaying game information and being located in a different one of said recesses of said support means, said interconnect means being located rearwardly of said support means adjacent to said apertures and including means in cooperative engagement with at least first and second ones of said display means through said apertures securing said display means to said support means, said display panel having clear and opaque areas and being located at said front surface of said support means forward of said display means, enclosing said display means within said support means with its clear areas in registration with said display units, exposing them to view, each of said display means including a display circuit board with its display unit mounted on the forward surface thereof and the peripheral edge of the display circuit board engaging said mounting shoulder, each display circuit board having a pattern of conductors printed on the rearward surface thereof inwardly of the peripheral edge of said board, certain ones of said conductors being connected to the display unit mounted on said display circuit board for extending control signals thereto, and said interconnect means including at least one interconnect circuit board having first and second connection means extending along first and second edges thereof and a pattern of conductors printed on a surface thereof and extending between said first and second edges and connected to said first and second connection means, said first and second connection means engaging conductors on a pair of display circuit boards whereby its conductors interconnect said conductors on said pair of display circuit boards, and a plurality of indicating devices mounted on the forward surface of said interconnect circuit board and located within further ones of said apertures in said frame, said display panel bearing indicia representing game status information and said indicating devices being selectively energizeable to selectively illuminate said indicia.

2. In a pinball maching including a lower playfield cabinet and an upper cabinet supported on the lower cabinet, a modular display assembly for providing a display of game information including player score and game status information, said modular display assembly comprising support means, a plurality of display means, interconnect means, and a display panel, said support means including a generally rectangular frame having top and bottom walls and a pair of side walls and having a front surface and a rear surface, said front surface having a plurality of recesses and a plurality of apertures through said support means from said front surface to said rear surface, the center portion of each recess being cut away defining certain ones of said apertures and the peripheral edges of each recess defining a mounting shoulder, each of said display means including a display unit for displaying game information and a display circuit board having the display unit mounted on the forward surface thereof, and being located in a different one of said recesses of said support means, with the peripheral edge of the display circuit board engaging said mounting shoulder of said recess of said support means adjacent to said apertures and including means in cooperative engagement with at least first and second ones of said display means through said apertures securing said display means to said support means, said display panel having clear and opaque areas and being located at said front surface of said support means forward of said display means, enclosing said display means within said support means with its clear areas in registration with said display units, exposing them to view, said forward edge of said frame cut back defining first and second shoulders in first and second opposing walls for receiving said display panel in flush relationship with the forward edge of said frame, and said support means further comprises locking means locking said display panel to said frame, said frame defining securing means for securing said locking means to said frame.

3. A pinball machine according to claim 2 wherein each of said display means comprises a display circuit board having a pattern of conductors printed thereon for extending control signals to its display unit, one of said interconnect means and said display means including a male connector having terminals connected to its conductors and the other one of said interconnect means and said display means including a female connector having terminals connected to its conductors, said interconnect means interconnecting conductors of one of said display means with conductors of the other display means.

4. A pinball machine according to claim 2 wherein each display circuit board has a pattern of conductors printed on the rearward surface thereof inwardly of the peripheral edge of said board, certain ones of said conductors being connected to the display unit mounted on said display circuit board for extending control signals thereto.

5. A pinball machine according to claim 4 wherein said interconnect means comprises at least one interconnect circuit board having first and second connection means extending along first and second edges thereof and a pattern of conductors printed on a surface thereof and extending between said first and second edges and connected to said first and second connection means, said first and second connection means engaging conductors on a pair of display circuit boards whereby its conductors interconnect said conductors on said pair of display circuit boards.

6. In a pinball machine including a lower playfield cabinet and an upper cabinet supported on the lower cabinet, a modular display assembly for providing a display of game information including player score and game status information, said modular display assembly comprising support means, first and second display means, interconnect means, and a display panel, said support means including a frame having a front surface and a rear surface, said front surface having a plurality of recessed portions and a plurality of apertures through said frame from said front surface to said rear surface, each of said display means being located in a different one of said recessed portions of said frame and including a display unit for displaying game information, and control signal distribution means for extending control signals to said display units, said interconnect means including an interconnect circuit board, a set of conductors disposed on a surface of said interconnect circuit board and connector means connected to said conductors, said interconnect circuit board being located rearwardly of said frame adjacent to ones of said apertures in the proximity of said first and second display means with its connector means extending through said apertures interconnecting the control signal distribution means of said first and second display means, said display panel having clear and opaque areas and being located on said front surface of said support means forward of said first and second display means, enclosing both said display means within said frame with its clear areas in registration with said display units exposing them to view, said support means further including locking means for locking said display panel to said frame.

7. A pinball machine according to claim 6, including a third display means located in a further one of said recessed portions of said frame and including a further display unit for displaying game information, and further control signal distribution means for extending control signals to said further display unit, said interconnect means including a further interconnect circuit board having a set of conductors disposed on a surface thereof and connector means connected to said conductors, said further interconnect circuit board being located rearwardly of said frame adjacent to further ones of said apertures in the proximity of said third and second display means with its connector means extending through said further apertures interconnecting the control signal distribution means of said third and second display means.

8. A pinball machine according to claim 7, wherein each of said display means further comprises a printed circuit board each mounting the associated display unit thereon and said control signal distribution means including a set of printed wiring conductors on each of said printed circuit boards of said first and second display means, and input circuit means connected to a set of printed wiring conductors on one of said printed circuit boards, and said further control signal distribution means including a set of printed wiring conductors on said printed circuit board of said third display means, said sets of printed wiring conductors of said first, second and third display means being interconnected by said interconnect means and said further interconnect means, and said input circuit means being connected to control circuitry for the pinball machine to provide control signals for selectively energizing display units of said first, second and third display means via said interconnected control signal distribution means.

9. A pinball machine according to claim 7, wherein said interconnect means further includes a plurality of indicating devices on each of said interconnect circuit board and said further interconnect circuit board, said display panel bearing indicia representing game status information, and said indicating devices being energizable to selectively illuminate said indicia.

10. A pinball machine according to claim 6, wherein said locking means comprises first and second elongated channel members each having forward and rearward legs, said first channel member being positioned on the top edge of said frame with its forward leg overlying a portion of the forward surface of said display panel near its upper edge, and said second channel member being positioned on the bottom edge of said frame, with its forward leg overlying a portion of the forward surface of the display panel near its bottom edge, and securing means projecting rearwardly from the top and bottom edges of said frame for securing said first and second channel members to said frame.

11. In a pinball machine including a lower playfield cabinet and associated control circuits and an upper cabinet supported on the lower cabinet, a modular display assembly for providing a display of game information including player score and game status information, said modular assembly comprising support means, a plurality of display means, interconnect means, and a display panel, said support means including a frame having a front surface and a rear surface and at least one aperture through said frame from said front surface to said rear surface, each of said display means including mounting means of an electrically insulating material, a display unit mounted on said mounting means for displaying game information, and a set of control signal distribution conductors disposed on said mounting means with at least certain ones of said conductors being connected to said display unit, one of said display means further including a set of input conductors selectively connected to said control signal distribution conductors, and connector means for connecting said input conductors to the control circuits, said plurality of display means being located at the front surface of said frame adjacent to said apertures, said interconnect means being located at the rear surface of said frame adjacent to said apertures and including means disposed in cooperative relationship with said plurality of display means through said apertures for securing said display means to said frame, said interconnect means including interconnect conductor means interconnecting control signal distribution conductors of said one display means with corresponding control signal distribution conductors of another one of said display means, said display panel being located at the front surface of said frame enclosing said first and second display means therewithin and defining a clear display area for exposing said display units to view.

12. A pinball machine according to claim 11, wherein said interconnect means further comprises a plurality of indicator means selectively energizable to illuminate areas of said display panel to provide game status information.

13. A pinball machine according to claim 11, wherein said interconnect means comprises further mounting means of an electrically insulating material, said interconnect conducor means comprising a set of printed wiring conductors disposed on a surface of said further mounting means, and said interconnect means further including connector means having terminals connected to said set of conductors and being constructed and arranged to engage conductor terminals on said display means mounting means.

* * * * *